US007760158B2

(12) United States Patent
Yoon et al.

(10) Patent No.: US 7,760,158 B2
(45) **Date of Patent: *Jul. 20, 2010**

(54) METHOD AND APPARATUS OF DRIVING A PLASMA DISPLAY PANEL

(75) Inventors: Sang Jin Yoon, Gyeongsangbuk-do (KR); Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 1107 days.

This patent is subject to a terminal disclaimer.

(21) Appl. No.: 10/968,037

(22) Filed: Oct. 20, 2004

(65) Prior Publication Data

US 2005/0128167 A1 Jun. 16, 2005

(30) Foreign Application Priority Data

Oct. 21, 2003 (KR) ..... 10-2003-0073530

(51) Int. Cl.
*G09G 3/28* (2006.01)

(52) U.S. Cl. ..... 345/60; 315/169.4

(58) Field of Classification Search ..... 345/60–72; 315/169.4

See application file for complete search history.

(56) References Cited

U.S. PATENT DOCUMENTS

| | | | | |
|---|---|---|---|---|
| 7,525,513 | B2 * | 4/2009 | Yoon et al. | 345/60 |
| 2002/0033675 | A1 | 3/2002 | Kang et al. | |
| 2003/0058119 | A1 | 3/2003 | Kang | |
| 2003/0137471 | A1 | 7/2003 | Iwami | |
| 2004/0135748 | A1 | 7/2004 | Yoon et al. | |

FOREIGN PATENT DOCUMENTS

| | | | |
|---|---|---|---|
| EP | 0965974 | * | 6/1999 |
| JP | 11259043 | * | 3/1998 |
| JP | 11-259043 | | 9/1999 |
| JP | 12-010522 | | 1/2000 |
| JP | 13-350448 | | 12/2001 |
| KR | 10-2001-0091213 | | 10/2001 |
| KR | 10-2001-0109471 | | 12/2001 |

* cited by examiner

*Primary Examiner*—Sumati Lefkowitz
*Assistant Examiner*—Seokyun Moon
(74) *Attorney, Agent, or Firm*—McKenna Long & Aldridge LLP

(57) ABSTRACT

The present invention relates to a plasma display panel, and more particularly, to a method and an apparatus for driving a plasma display panel. According to one aspect of the present invention, there is provided a method of driving a plasma display panel, including the steps of selecting an operating mode based on the degree in which a data moves, and controlling differently at least one of an arrangement of sub-fields disposed within one frame period and the number of sustain pulses according to the selected operating mode. According to the method and apparatus of driving the plasma display panel of the present invention, it is thus possible to increase the picture quality when displaying data of different media such as a PC data or a TV data, power consumption can be reduced, and it is possible to extend the lifespan of a plasma display panel.

15 Claims, 8 Drawing Sheets

METHOD AND APPARATUS OF DRIVING A PLASMA DISPLAY PANEL

This nonprovisional application claims priority under 35 U.S.C. §119(a) on Patent Application No. 10-2003-0073530 filed in Korea on Oct. 21, 2003, the entire contents of which are hereby incorporated by reference.

BACKGROUND OF THE INVENTION

1. Field of the Invention

The present invention relates to a plasma display panel, and more particularly, to a method and an apparatus for driving a plasma display panel.

2. Description of the Background Art

There is a growing interest in a flat panel display device in which the weight and volume of a cathode ray tube can be reduced. This flat panel display device may include a liquid crystal display, a plasma display panel (PDP), a field emission display, electro-luminescence display and the like. It supplies a digital signal or an analog data to a display panel.

The plasma display panel is adapted to display an image by light-emitting phosphors with ultraviolet generated during the discharge of a gas such as a He+Xe or Ne+Xe gas. This PDP can be easily made thin and large, and it can provide greatly improved image quality with the recent development of the relevant technology.

Particularly, a three-electrode AC surface discharge type PDP has advantages of lower driving voltage and longer product lifespan as a dielectric layer on which a wall charge is accumulated in discharging is employed and electrodes are protected from sputtering generated by plasma discharging.

FIG. 1 is a perspective view showing the construction of a cell of a three-electrode AC surface discharge type plasma display panel.

Referring to FIG. 1, a cell of a three-electrode AC surface discharge type plasma display panel includes a scan/sustain electrode 30Y and a common sustain electrode 30Z which are formed on an upper substrate 10, and an address electrode 20X formed on a lower substrate 18.

The scan/sustain electrode 30Y includes a transparent electrode 12Y and a metal bus electrode 13Y, which has a line width smaller than that of the transparent electrode 12Y and is formed at one edge of the transparent electrode. The common sustain electrode 30Z includes a transparent electrode 12Z and a metal bus electrode 13Z, which has a line width smaller than that of the transparent electrode 12Z and is formed at one edge of the transparent electrode. The transparent electrodes 12Y, 12Z can be formed using a transparent conductive material, e.g., indium-tin-oxide (ITO). The metal bus electrodes 13Y, 13Z are formed of a metal having high conductivity and serve to compensate for electrical properties of the transparent electrodes 12Y, 12Z having high resistance.

An upper dielectric layer 14 and a protection film 16 are laminated on the upper substrate 10 in which the scan/sustain electrode 30Y and the common sustain electrode 30Z are formed. The upper dielectric layer 14 is accumulated with ionized charged particles generated upon discharging. The charged particles accumulated on the dielectric layer 14 are called 'wall charge'. The protection film 16 serves to protect the upper dielectric layer 14 from sputtering of the charged particles generated upon discharging and to increase emission efficiency of secondary electrons. The protection film 16 is typically formed using magnesium oxide (MgO).

The address electrode 20X is formed on the lower substrate 18 in the direction where it intersects the scan/sustain electrode 30Y and the common sustain electrode 30Z. A lower dielectric layer 22 and barrier ribs 24 are formed on the lower substrate 18 in which the address electrode 20X is formed. The lower dielectric layer 22 serves to protect the address electrode 20X and increase optical efficiency by reflecting light that proceeds toward the lower substrate 18 upon discharging.

A phosphor layer 26 is formed on the lower dielectric layer 22 and the barrier ribs 24. The barrier ribs 24 are formed in a direction parallel to the address electrode 20X, and it physically divides cells to prevent ultraviolet and a visible ray generated by the discharging from leaking toward cells that are adjacent to one another horizontally. Therefore, optical crosstalk between the cells is prevented and charged particles generated by the discharging are prevented from moving toward cells that are adjacent to one another horizontally, so that electrical crosstalk between the cells is prevented. The phosphor layer 26 is excited by ultraviolet rays generated upon discharging to generate a visible ray of one of red, green and blue. Inert mixed gases such as He+Xe, Ne+Xe and He+Ne+Xe for discharge are inserted into discharge spaces defined between the upper substrates 10 and the barrier ribs 24 and the lower substrates 18 and the barrier ribs 24.

FIG. 2 shows an example of a sub-field in which a frame period is time-divided into eight sub-fields.

In such three-electrode AC surface discharge type PDP, one frame period is driven with it time-divided into several sub-fields having different numbers of emission as shown in FIG. 2 in order to implement the gray scale of a picture. Each of the sub-fields is divided into a reset period for uniformly initializing all cells, an address period for selecting a cell and a sustain period for implementing the gray scale depending on discharge frequency. For example, if it is desired to display a picture using 256 gray scales, a frame period (16.67 ms) corresponding to 1/60 second is time-divided into eight sub-fields SF1 to SF8 as shown in FIG. 2. Furthermore, each of the eight sub-fields includes a reset period, an address period and a sustain period. In the above, the reset period and the address period of each of the sub-fields are the same every sub-field, whereas the sustain period and the discharging frequency of the sustain increase in the ratio of $2^n$(n=0,1,2,3,4,5,6,7) in each sub-field.

A method of driving a plasma display panel can be largely classified into a selective write (SW) mode and a selective erase (SE) mode depending on a select mode of a cell.

The selective write mode includes initializing all cells in a reset period and then selecting a cell to be turned on (hereinafter, referred to as 'on-cell') in an address period. In a sustain period of the selective write mode, sustain discharge is generated in the on-cell.

In this selective write mode, a scan pulse supplied to the scan/sustain electrode 30Y has a relatively wide pulse width. For this reason, in the selective write mode, the address period becomes long. Therefore, this mode has a disadvantage that it is difficult to secure the sustain period sufficiently.

Meanwhile, the plasma display panel is adapted to implement the gray scale of a picture through a combination of sub-fields and thus has contour noise in a motion picture. If the contour noise is generated, the display quality is degraded. For example, if the left half of a screen is displayed as a gray scale value of 128, the right half of the screen is displayed as a gray scale value of 127 and the screen then moves to the left, a peak white, i.e., a white stripe appears at the boundary between the gray scale values 128 and 127. On the contrary, if the left half of the screen is displayed as a gray scale value of 127, the right half of the screen is displayed as a gray scale value of 128 and the displayed screen moves to the right, a black level, i.e., a black stripe appears at the boundary between the gray scale values 128 and 127.

Methods of removing contour noise of a motion picture may include a method of dividing one sub-field and adding 1 or 2 sub-fields, a method of re-arranging the order of sub-fields, a method of adding sub-fields and re-arranging the order of the sub-fields, an error diffusion method and the like.

If sub-fields are added in order to remove motion picture contour noise in the selective write mode, the sustain period shrinks as much as the address period extends. For example, assuming that sub-fields of the selective write mode extend to 10 and a pulse width of a scan pulse is 3 μs in a plasma display panel having a resolution of VGA 640×480, the sustain period shrinks absolutely as follows. An address period occupied by one frame period of 16.67 ms is 3 μs (a pulse width of a scan pulse)×480 lines×10 (the number of sub-fields)=14.4 ms. On the contrary, a sustain period occupied by one frame period is −0.03 ms in which the one frame period of 16.67 ms minus the address period of 14.4 ms, once reset period of approximately 0.3 ms, an erase period of 100 μs×10 (the number of sub-fields) and a vertical synchronization signal (vsync) marginal period of 1 ms.

In order to solve the shortage of the driving time, a method has been proposed in which a plasma display panel is physically divided and respective screen blocks are driven at the same time. However, this method has a problem in that the manufacturing cost increases since driving integrated circuits have to be added.

Meanwhile, the selective erase mode includes initializing all cells in the reset period and selecting a cell to be turned off (hereinafter, referred to as -cell') in the address period. Further, in the sustain period of the selective erase mode, sustain discharge is generated within the off-cell.

A scan pulse needed for the selective erase mode can be set to be small compared to that of the selective write mode. Accordingly, in the selective erase mode, the address period is smaller than that of the selective write mode. It is thus possible to secure a sustain period relatively widely. For example, assuming that one frame period is time-divided into eight sub-fields and a pulse width of a scan pulse is 1 μs in a plasma display panel of VGA resolution, an address period occupied by the one frame period is relatively small, i.e., 1 μs (a pulse width of a scan pulse)×480 lines×8 (the number of sub-fields) =3.84 ms. A sustain period occupied by the one frame period is approximately 11.03 ms in which the one frame period minus the address period of 3.84 ms, a vertical synchronization signal (vsync) marginal time of 1 ms, a reset period of 100 μ(the reset period)×8 (the number of sub-fields), and the entire surface writing period. As such, in the selective erase mode, the address period shrinks. Accordingly, this mode has an advantage that it can easily secure a sustain period even when the number of sub-fields extends.

However, in the selective erase mode, the entire cells are turned on in the reset period and black brightness rises in the contrast ratio. Therefore, this mode has a disadvantage that a contrast characteristic is degraded.

The applicant of the present application proposed a method and apparatus (hereinafter, referred to as 'SWSE mode') for time-dividing one frame period into sub-fields of a selective write mode (hereinafter, referred to as 'SW sub-field') and sub-fields of a selective erase mode (hereinafter, referred to as 'SE sub-field') under a given condition in order to solve the shortage of a driving time generated in the selective write mode and lowering of a contrast characteristic generated in the selective erase mode (see U.S. Pat. Publication No. US-2002-0033675-A1).

FIG. 3 shows an example that sub-fields of a SWSE mode are arranged.

Meanwhile, the SWSE mode includes time-dividing one frame period into 6 SW sub-fields SF1 to SF6 each of which selects an on-cell in the selective write mode and 6 SE sub-fields SF7 to SF12 each of which selects an off-cell in the selective erase mode, referring to FIG. 3.

The SW sub-fields SF1 to SF6 can represent 64 gray scales through binary coding. The SE sub-fields SF7 to SF12 can represent 7 gray scales through linear coding. A total number of a gray scale that can be represented through a combination of the SW sub-fields SF1 to SF6 and the SE sub-fields SF7 to SF12 is 64×7=448.

Meanwhile, researches have actively been made into a method in which a PDP operates in the PC mode as well as the AV mode so that it can be used both in a television and a monitor of a computer, a bulletin board, a broadcasting board, etc. In this time, the AV mode refers to an operating mode corresponding to TV on which a motion picture is typically displayed. Meanwhile, the PC mode refers to an operating mode corresponding to the monitor on which a still picture is typically displayed.

Optimal conditions required by the AV mode and the PC mode are different from each other. That is, it is required that in the AV mode, pseudo contour noise that easily appears in the motion picture be reduced, whereas in the PC mode, a picture be represented using a large number of gray scales.

SUMMARY OF THE INVENTION

Accordingly, an object of the present invention is to solve at least the problems and disadvantages of the background art.

An object of the present invention is to provide a method and an apparatus for driving a plasma display panel in which an AV mode and a PC mode can be optimized to reduce pseudo contour noise in a motion picture and a picture can be represented using a large number of gray scale in a still picture.

According to one aspect of the present invention, there is provided a method of driving a plasma display panel, including the steps of selecting an operating mode based on the degree in which a data moves, and controlling differently at least one of an arrangement of sub-fields disposed within one frame period and the number of sustain pulses according to the selected operating mode.

According to another aspect of the present invention, there is also provided an apparatus for driving a plasma display panel, including a mode select unit that selects an operating mode based on the degree in which data moves, and a control unit that differently controls at least one of an arrangement of sub-fields disposed within one frame period and the number of sustain pulses according to the selected operating mode.

According to the method and apparatus of driving the plasma display panel of the present invention, sub-field mapping is optimized depending on the operating mode of the AV mode and the PC mode or motion of a picture. It is thus possible to increase the picture quality when displaying data of different media such as a PC data or a TV data. Further, the number of sustain pulses is controlled depending on the operating mode of the AV mode and the PC mode or motion of a picture. Therefore, power consumption can be reduced by reducing the number of sustain pulses within a range that rarely affects the picture quality in the PC mode or the still picture. Also, it is possible to extend the lifespan of a plasma display panel by reducing degradation of phosphors that becomes keen as discharging frequency increases.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
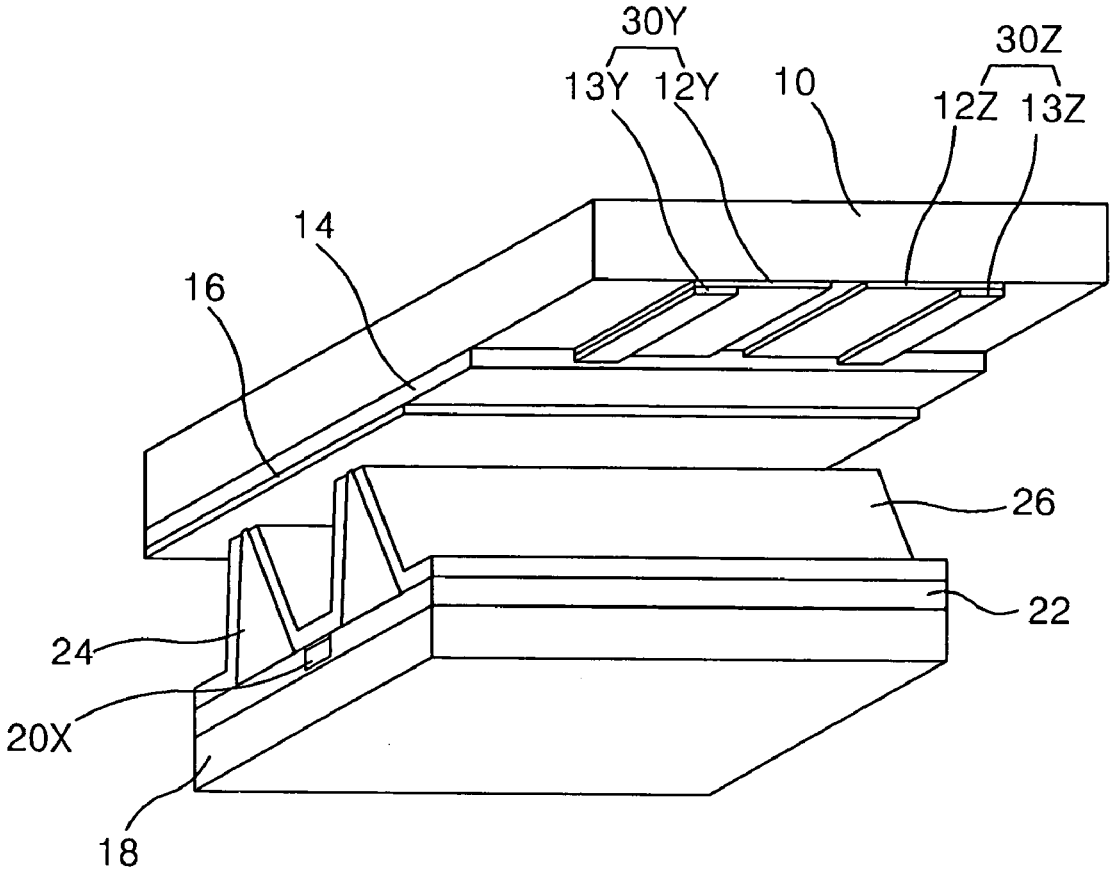
FIG. 1 is a perspective view showing the construction of a cell of a three-electrode AC surface discharge type plasma display panel.
Figure 2:
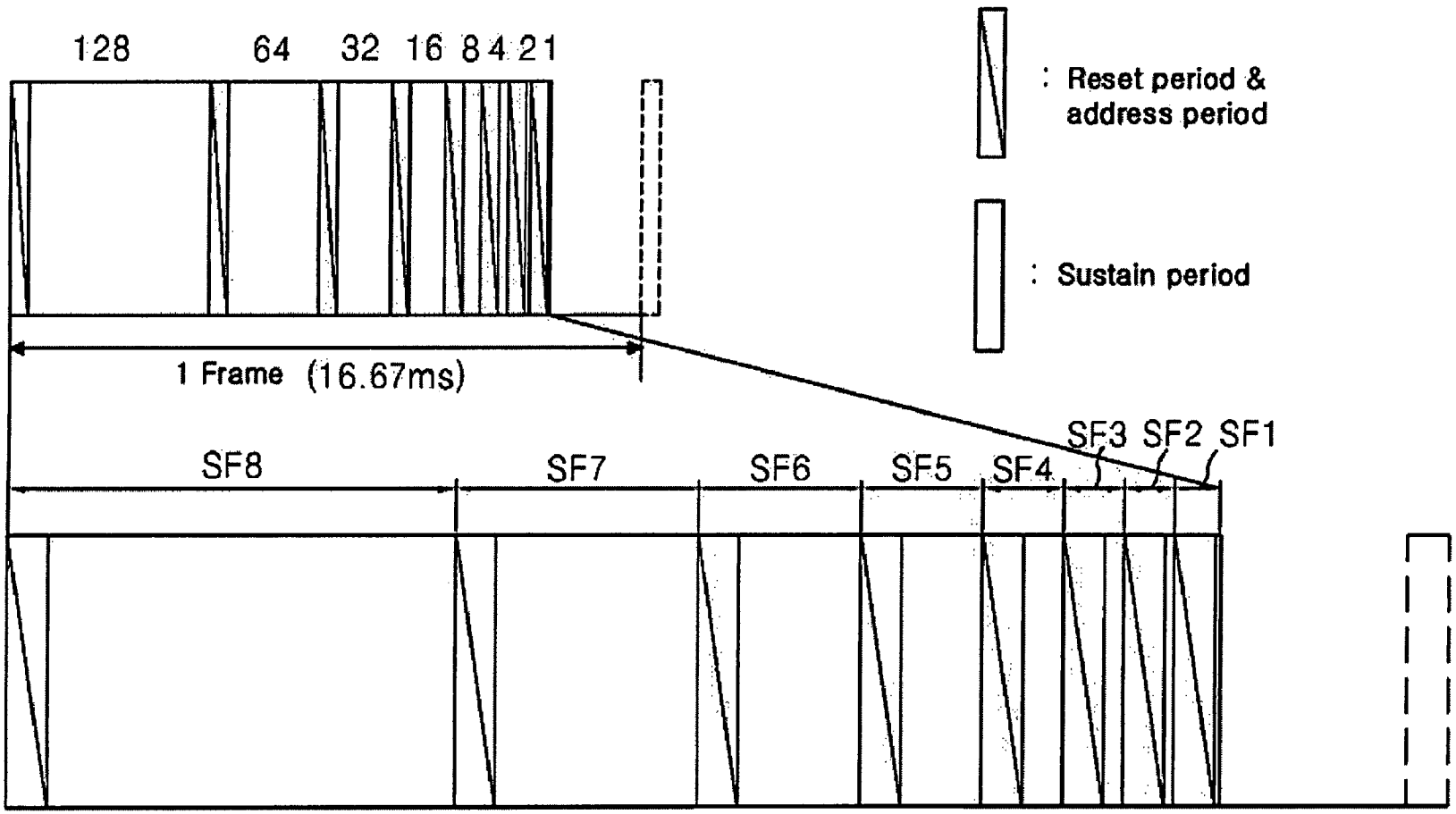
FIG. 2 shows an example of a sub-field in which a frame period is time-divided into eight sub-fields.
Figure 3:
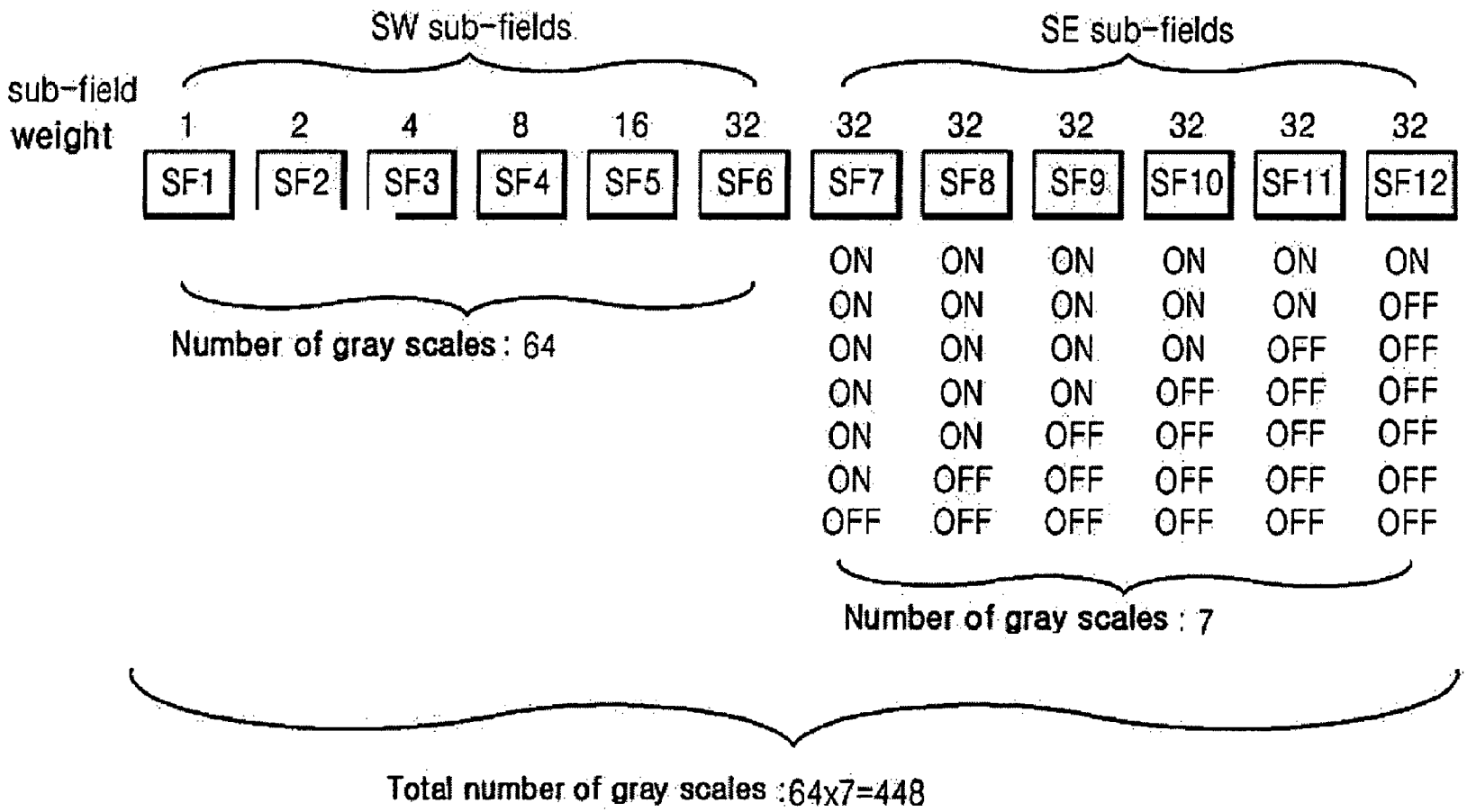
FIG. 3 shows an example that sub-fields of a SWSE mode are arranged.

According to one aspect of the present invention, a method of driving a plasma display panel comprises the steps of: selecting an operating mode based on the degree in which a data moves; and controlling differently at least one of an arrangement of sub-fields disposed within one frame period and the number of sustain pulses according to the selected operating mode.

The method of driving a plasma display panel further comprises the step of receiving at least one of a signal from a remote controller that remotely controls the plasma display panel, a cable signal connected to different media, and a signal from a mode select switch separately disposed in the plasma display panel.

The step of selecting the operating mode includes determining the operating mode in response to the received signal.

The step of selecting the operating mode includes comparing frames of the data to calculate the amount of variations and comparing the amount of variations with a predetermined reference value to select the operating mode.

The arrangement of the sub-fields includes: at least one selective write (SW) sub-field that selects on-cells in an address period, and at least one selective erase (SE) sub-field that selects off-cells in an address period.

The step of controlling differently at least one of the arrangement of the sub-fields and the number of the sustain pulse comprises the step of: making the number of the SE sub-fields greater than the number of the SW sub-fields if the operating mode is an AV mode in which the movement degree of the data is great.

The step of controlling differently at least one of the arrangement of the sub-fields and the number of the sustain pulse comprises the step of: making the number of the selective write sub-fields greater than the number of the selective erase sub-fields if the operating mode is a PC mode in which the movement degree of the data is small.

The step of controlling differently at least one of the arrangement of the sub-fields and the number of the sustain pulses comprises the steps of: if the operating mode is an AV mode in which the movement degree of the data is great, selecting a first sub-field arrangement in which sub-fields are arranged so that contour noise is small in a motion picture; and if the operating mode is a PC mode in which the movement degree of the data is small, selecting a second sub-field arrangement in which sub-fields are arranged so that a range of the gray scale to be represented is wider than that of the first sub-field arrangement.

The step of controlling differently at least one of the arrangement of the sub-fields and the number of the sustain pulses comprises the step of: if the operating mode is a PC mode in which the movement degree of the data is small, controlling the number of the sustain pulses to be smaller than the number of sustain pulses that is set corresponding to an AV mode in which the movement degree of the data is great.

The step of controlling differently at least one of the arrangement of the sub-fields and the number of the sustain pulse comprises the step of: if the operating mode is a PC mode in which the movement degree of the data is small, lowering the number of the sustain pulses so that the data can be displayed as the average brightness between 50% and 80% against the average brightness of the data that is displayed on the plasma display panel in an AV mode in which the movement degree of the data is great.

According to another aspect of the present invention, an apparatus for driving a plasma display panel, comprises: a mode select unit that selects an operating mode based on the degree in which data moves; and a control unit that differently controls at least one of an arrangement of sub-fields disposed within one frame period and the number of sustain pulses according to the selected operating mode.

The mode select unit receives at least one of a signal from a remote controller that remotely controls the plasma display panel, a cable signal connected to different media, and a signal from a mode select switch separately disposed in the plasma display panel; and determines the operating mode in response to the received signal.

The mode select unit compares frames of the data to calculate the amount of variations and compares the amount of variations with a predetermined reference value to select the operating mode.

The control unit arranges, within the one frame period, at least one selective write (SW) sub-field that selects on-cells in an address period and at least one selective erase (SE) sub-field that selects off-cells in an address period, and if the operating mode selected by the mode select unit is an AV mode in which the movement degree of the data is great, makes the number of the SE sub-fields greater than the number of the SW sub-fields.

The control unit arranges, within the one frame period, at least one selective write sub-field that selects on-cells in an address period and at least one selective erase sub-field that selects off-cells in an address period, and if the operating mode selected by the mode select unit is a PC mode in which the movement degree of the data is small, makes the number of the SW sub-fields greater than the number of the SE sub-fields.

The control unit maps the data to a first sub-field arrangement in which sub-fields are arranged so that contour noise is small in a motion picture if the operating mode selected by the mode select unit is an AV mode in which the movement degree of the data is great, and maps the data to a second sub-field arrangement in which sub-fields are arranged so that a range of the gray scale to be represented is wider than that of the first sub-field arrangement if the operating mode selected by the mode select unit is a PC mode in which the movement degree of the data is small.

The control unit controls the number of the sustain pulses to be smaller than the number of sustain pulses that is set corresponding to an AV mode in which the movement degree of the data is great if the operating mode selected by the mode select unit is a PC mode in which the movement degree of the data is small.

The control unit lowers the number of the sustain pulse so that the data can be displayed as the average brightness between 50% and 80% against the average brightness of the data that is displayed on the plasma display panel in the AV mode in which the movement degree of the data is great if the operating mode selected by the mode select unit is the PC mode in which the movement degree of the data is small.

Hereafter, preferred embodiments of the present invention will be described in a more detailed manner with reference to the drawings.

Figure 4:
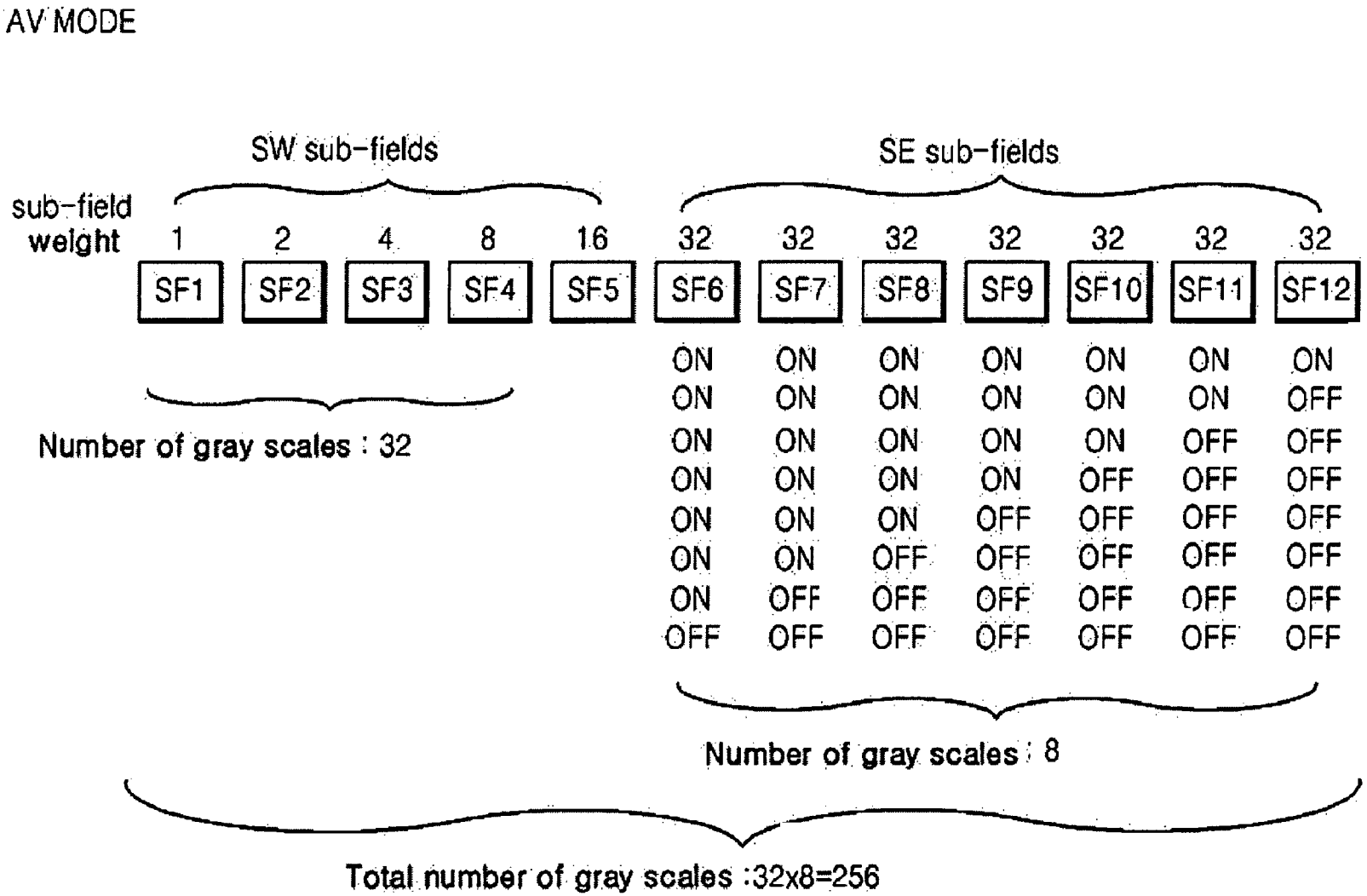
FIG. 4 shows an example that sub-fields of an AV mode are arranged in a method of driving a plasma display panel according to an embodiment of the present invention.
Figure 5:
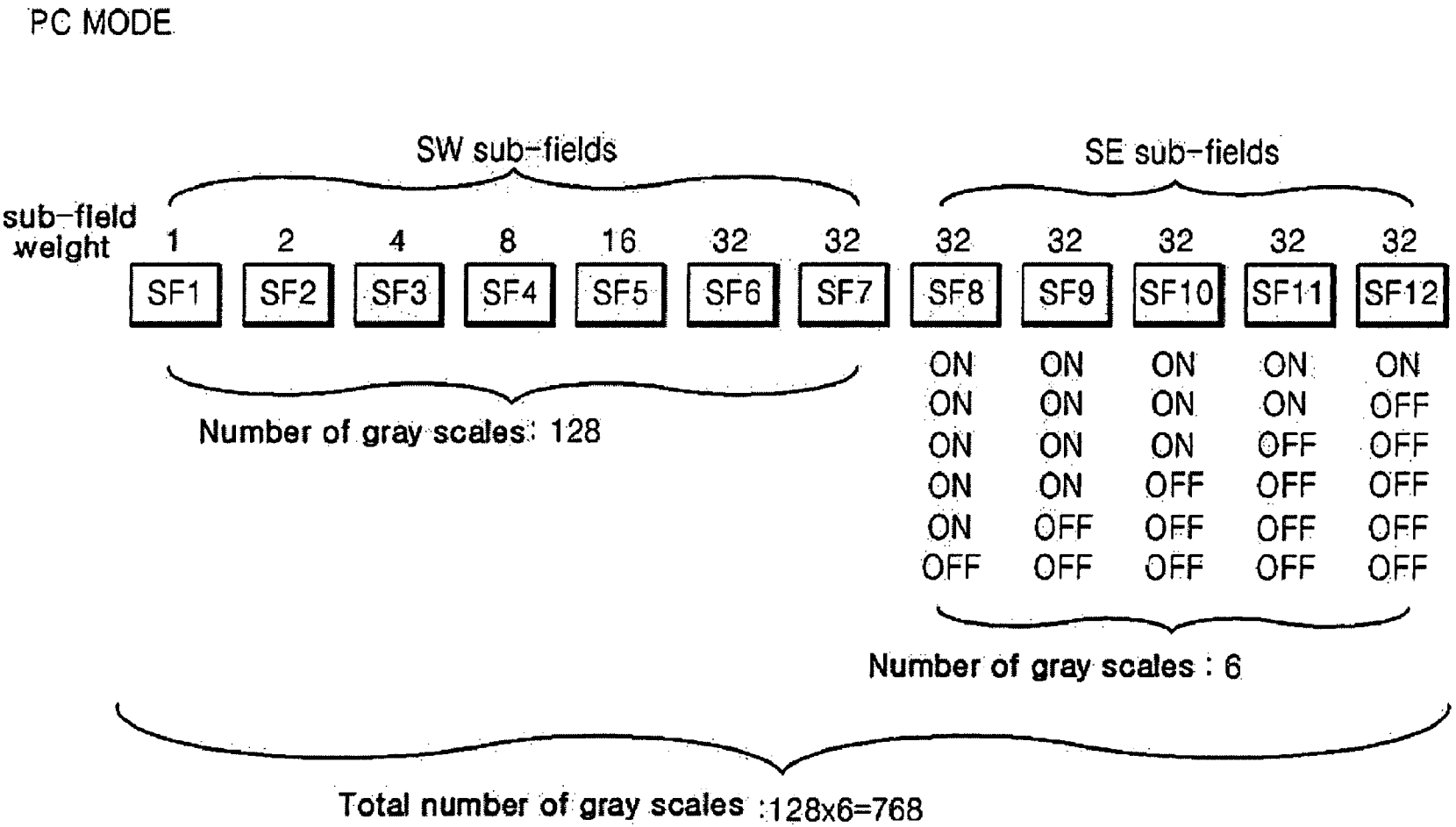
FIG. 5 shows an example that sub-fields of a PC mode are arranged in a method of driving a plasma display panel according to an embodiment of the present invention.

FIG. 4 shows an example that sub-fields of an AV mode are arranged in a method of driving a plasma display panel according to an embodiment of the present invention. FIG. 5 shows an example that sub-fields of a PC mode are arranged in a method of driving a plasma display panel according to an embodiment of the present invention.

Referring first to FIG. 4, in the method of driving the plasma display panel according to the present invention, SE sub-fields SF6 to SF12 whose number is greater than that of SW sub-fields SF1 to SF5 are arranged within one frame period in an AV mode. On the contrary, SW sub-fields SF1 to SF7 whose number is greater than that of the SE sub-fields SF8 to SF12 are arranged within one frame period in a PC mode as shown in FIG. 5.

Accordingly, in the AV mode as shown in FIG. 4, the SW sub-fields SF1 to SF5 can represent 32 gray scales through binary coding and the SE sub-fields SF6 to SF12 can represent 8 gray scales through linear coding. Therefore, in the AV mode, the total number of 256 gray scales can be represented through a combination of the SW sub-fields SF1 to SF5 and the SE sub-fields SF6 to SF12.

In the PC mode as shown in FIG. 5, the SW sub-fields SF1 to SF7 can represent 128 gray scales through binary coding and the SE sub-fields SF8 to SF12 can represent 6 gray scales through linear coding. Accordingly, in the AV mode, the total number of 768 gray scales can be represented through a combination of the SW sub-fields SF1 to SF5 and the SE sub-fields SF6 to SF12.

Therefore, according to the method of driving the plasma display panel of the present invention, in the PC mode, the number of the SW sub-fields extends to expand the range that the gray scale can be represented. Due to this, a still picture can be represented in more detail.

Each of the SW sub-fields SF1 to SF5 or SF1 to SF7 includes an address period for selecting on-cells and a sustain period that causes sustain discharge to occur for on-cells only as many as discharging frequency corresponding to predetermined weight. Each of the SW sub-fields SF1 to SF4 or SF1 to SF7 may include a reset period for initializing all cells depending on sub-fields, and an erase period for erasing charges remaining in cells after the sustain discharge is finished. The sub-field SF5 or SF7 of the SW sub-fields, which is the last sub-field, does not include the erase period so that off-cells can be selected from the first SE sub-field SF6 or SF8. In the SW sub-fields SF1 to SF5 or SF1 to SF7, the reset period, the address period and the erase period are the same in each sub-field, whereas the sustain period and the discharging frequency of the sustain differ every sub-field depending on weight '$2^0$(1), $2^1$(2), $2^2$(4), $2^3$(8), $2^4$(16)' or '$2^0$(1), $2^1$(2), $2^2$(4), $2^3$(8), $2^4$(16), $2^5$(32), $2^5$(32)' which are assigned to the sub-fields.

Each of the SE sub-fields SF6 to SF12 or SF8 to SF12 includes an address period for selecting off-cells, and a sustain period that causes sustain discharge to occur for off-cells only as many as discharging frequency corresponding to predetermined weight. The sub-fields SF6 to SF11 or SF8 to SF11 of the SE sub-fields except for the last sub-field do not include a reset period and an erase period. The last SE sub-field SF12 does not include the reset period, but includes the erase period for erasing charges remaining in cells after the sustain period, so that initialization of the first sub-field SF1 can be stabilized. Weights respectively assigned to the SE sub-fields SF6 to SF12 or SF8 to SF12 are '32'. For this reason, the address period and the sustain period are the same in each of the SE sub-fields SF6 to SF12 or SF8 to SF12. Meanwhile, different weights can be assigned even to the SE sub-fields SF6 to SF12 or SF8 to SF12 in the same manner as the SW sub-fields SF1 to SF5 or SF1 to SF7. In this case, the sustain period of each of the SE sub-fields SF6 to SF12 or SF8 to SF12 may differ depending on weight.

The SW sub-fields SF1 to SF5 SF1 to SF7 can select on-cells through binary coding and thus arbitrarily select the on-cells regardless of selected cells in each sub-field.

On the contrary, the SE sub-fields SF6 to SF12 can select off-cells through linear coding that selects off-cells from on-cells that are selected or not selected in a previous sub-field. It is thus required that on-cells exist in the previous sub-field inevitably. For example, the first SE sub-field SF6 or SF8 can select an off-cell from the on-cells selected in the last SW sub-field SF5 or SF7. Also, the second to last SE sub-fields SF7 to SF12 or SF9 to SF12 can select off-cells from on-cells that are not selected in a previous sub-fields SF6 to SF11 or SF8 to SF11. In other words, the SE sub-fields SF6 to SF12 or SF8 to SF12 turn off on-cells whenever they go over sub-fields. Accordingly, contour noise generated due to discontinuous variations in the intensity of radiation in a motion picture rarely appears in the SE sub-fields SF6 to SF12 and SF8 to SF12.

Therefore, according to the method of driving the plasma display panel of the present invention, in the AV mode, the number of the SE sub-fields is extended. Accordingly, contour noise can be reduced when representing a motion picture.

An example for representing the gray scale in the AV mode and the PC mode is as follows. In the AV mode as shown in FIG. 4 and the TV mode as shown in FIG. 5, cells that are represented as a gray scale value of '13' are turned on in the first, third and fourth sub-fields SF1, SF3 and SF4 but turned off in the remaining sub-fields SF2, SF5 to SF12, through a binary code combination. On the contrary, cells that are represented as a gray scale value of '75' are turned on in the first, second and fourth sub-fields SF1, SF2 and SF4 through a binary code combination and are turned on in the sixth and seventh sub-fields SF6 and SF7 through a linear code combination, but they are turned off in the remaining sub-fields SF3, SF5, SF8 to SF12.

In a plasma display panel having resolution of VGA 640×480, if a scan pulse of SW sub-fields is 3 μs and a scan pulse of SE sub-fields is 1 μs, an address period and a sustain period can be calculated as follows.

If the plasma display panel is driven in the AV mode as shown in FIG. 4, an address period occupied within one frame period is {3 us(a scan pulse of a SW sub-field)×480 (a line number)×5 (the number of SW sub-fields)}+{1 us(a scan pulse of a SE sub-field)×480 (a line number)×7 (the number of SE sub-fields)}=10.56 ms. In this case, a sustain period is 16.67 ms (1 frame period)−10.56 ms (the address period)−1 ms (a vertical synchronization signal marginal period)−400 μs (an erase period of SF1 to SF4)=4.71 ms.

Further, if the plasma display panel is driven in the PC mode as shown in FIG. 5, an address period occupied within one frame period is {3 us(a scan pulse of a SW sub-field)×480 (a line number)×7 (the number of SW sub-fields)}+{1 us(a scan pulse of a SE sub-field)×480 (a line number)×7 (the number of SE sub-fields)}=11.8 ms. In this case, a sustain period is 16.67 ms (1 frame period)−11.8 ms (the address period)−1 ms (the vertical synchronization signal marginal period)−600 μs (an erase period of SF1 to SF6)=3.27 ms.

Figure 6:
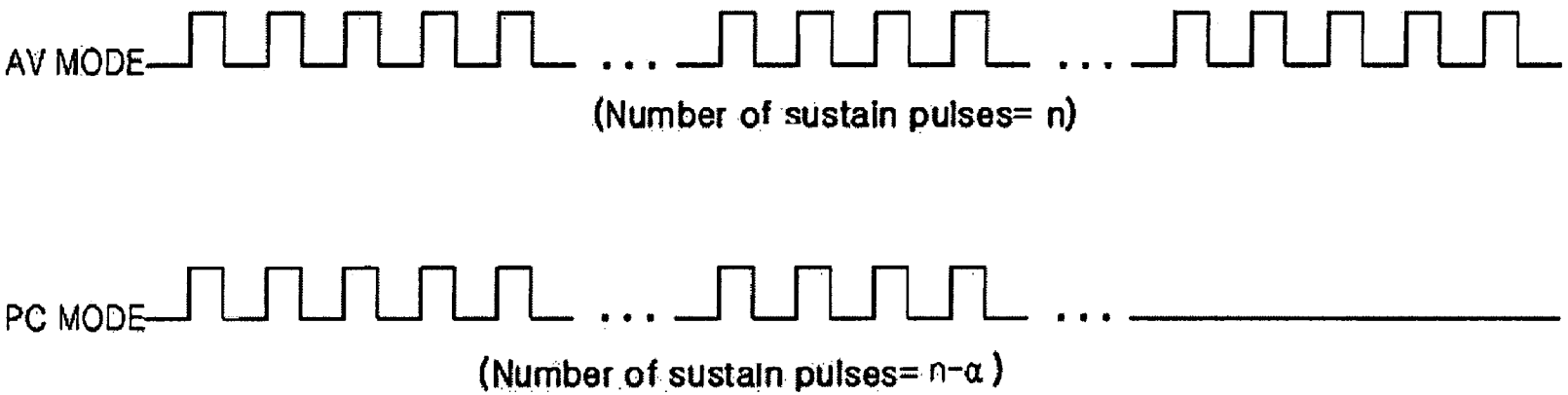
FIG. 6 shows waveforms of sustain pulses each allocated to an AV mode and a PC mode in a method of driving a plasma display panel according to an embodiment of the present invention.

FIG. 6 shows the number of sustain pulses in the AV mode and the PC mode, for explaining a method of driving a plasma display panel according to another embodiment of the present invention.

Referring to FIG. 6, in the plasma display panel according to the present invention, the number of sustain pulses (n-α) allocated to the PC mode reduces compared to the number of sustain pulses (n) allocated to the AV mode. In this embodiment, one frame period can be time-divided into SW sub-fields only, SE sub-fields only, or SW sub-fields and SE sub-fields. Preferably, an arrangement of sub-fields of a SWSE mode is selected considering the display quality and a driving time in a motion picture.

If the total number of a sustain pulse of all sub-fields arranged within one frame period is n in the AV mode, the total number of a sustain pulse of all sub-fields arranged within one frame period is n-α in the PC mode, which is reduced by α compared to that of the AV mode. Such a difference in the number of the sustain pulse is the same as a difference in the discharging frequency of sustain. Thus, there is a difference in the average brightness of a plasma display panel between the AV mode and the PC mode when a picture of the same one frame is displayed.

A reduction portion 'α' of the number of the sustain pulse allocated in the PC mode is determined so that the average brightness of the PC mode becomes between 50% and 80% when the average brightness of the AV mode is 100% in order for the reduction portion not to have a bad influence upon the picture quality.

Figure 7:
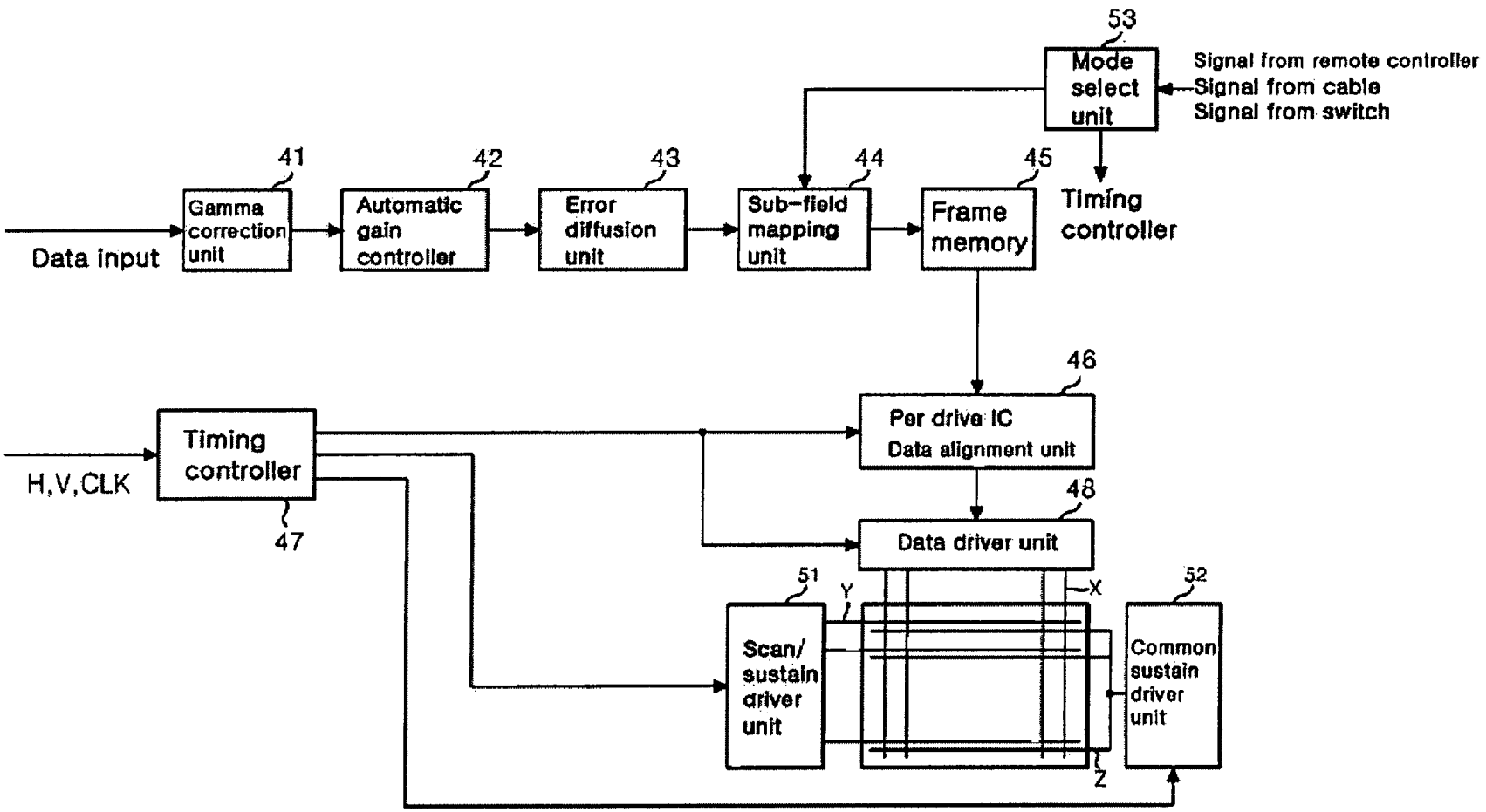
FIG. 7 is a block diagram illustrating an apparatus for driving a plasma display panel according to a first embodiment of the present invention.

FIG. 7 is a block diagram illustrating an apparatus for driving a plasma display panel according to the present invention.

Referring to FIG. 7, the apparatus according to the present invention includes a data driver unit 48; a scan/sustain driver unit 51 and a common sustain driver unit 52 which are connected to electrodes X, Y and Z of the plasma display panel, respectively; an automatic gain controller 42, an error diffusion unit 43, a sub-field mapping unit 44 and a frame memory 45 all of which are connected between a gamma correction unit 41 and a data alignment unit 46; a timing controller 47 for controlling an operational timing of each of driver circuits; and a mode select unit 53 connected to the sub-field mapping unit 44.

The data driver unit 48 includes a plurality of integrated circuits for supplying data to a plurality of address electrodes X during an address period.

The scan/sustain driver unit 51 serves to generate an initialization waveform for initializing all cells during an initialization period, and it serves to sequentially generate scan pulses of SW sub-fields or scan pulses of SE sub-fields during the address period. Further, the scan/sustain driver unit 51 functions to generate a sustain pulse during a sustain period. The scan driver unit 51 has a plurality of integrated circuits. A signal generated from the scan/sustain driver unit 51 is provided to a plurality of scan/sustain electrodes Y of the plasma display panel.

The common sustain driver unit 52 is connected to the common sustain electrodes Z and serves to supply a sustain pulse to the plurality of the sustain electrodes Z at the same time during the sustain period.

The timing controller 47 serves to receive horizontal/vertical synchronization signals H,V and a clock signal CLK and generate timing control signals needed for the units 46, 48, 51 and 52, respectively. Furthermore, the timing controller 47 functions to control the number of sustain pulses differently depending on a signal received from the mode select unit 53. That is, the timing controller 47 serves to control the scan/sustain driver unit 51 and the common sustain driver unit 52 using the number of sustain pulses that is set lower than the number of the sustain pulse of the AV mode if a current operating mode is determined to be a PC mode by the mode select unit 53. Accordingly, the scan/sustain driver unit 51 and the common sustain driver unit 51 generate different numbers of a sustain pulse in the AV mode and the PC mode under the control of the timing controller 47.

The gamma correction unit 41 serves to perform a gamma correction on a picture signal and thus linearly change a brightness value depending on a gray scale value of the picture signal.

The automatic gain controller 42 functions to compensate for color temperature by controlling the gain of a data from the gamma correction unit 41 by the red, green and blue.

The error diffusion unit 43 serves to finely control a brightness value by diffusing a quantization error component to neighboring cells.

The sub-field mapping unit 44 determines whether a current operating mode is an AV mode or a PC mode based on the signal received from the mode select unit 53, and it selects an optimum arrangement of sub-fields depending on a corresponding mode. Further, the sub-field mapping unit 44 serves to map data to the selected sub-field arrangement by the bit. For example, the sub-field mapping unit 44 can map data to a sub-field arrangement in which SE sub-fields whose number is greater than that of SW sub-fields are arranged in the AV mode as in FIG. 4. On the contrary, the sub-field mapping unit 44 can map data to a sub-field arrangement in which SW sub-fields whose number is greater than that of SE sub-fields are arranged in the PC mode as in FIG. 5. The data mapped by the sub-field mapping unit 44 is stored in the frame memory 45 and is then provided to the data alignment unit 46.

The data alignment unit 46 serves to distribute the data received from the frame memory 45 corresponding to the integrated circuits of the data driver unit 48.

The mode select unit 53 senses a mode select signal received through a remote controller, an AC cable/PC cable signal connected to a terminal disposed in the plasma display panel or a signal of a mode select switch disposed in the plasma display panel and then selects a current operating mode. In other words, if a user selects a mode through the remote controller or connects a TV cable or a PC cable to a select terminal of the plasma display panel, or manipulates a switch separately disposed in the plasma display panel to select a given mode, the mode select unit 53 senses the mode selected by the user or the cable signal and then selects a mode. Further, the mode select unit 53 supplies a mode data indicating whether a current operating mode is the AV mode or the PC mode to the timing controller 47 and the sub-field mapping unit 44. The timing controller 47 and the sub-field mapping unit 44 control an arrangement of sub-fields or the number of sustain pulses differently depending on a current operating mode, as described above.

Figure 8:
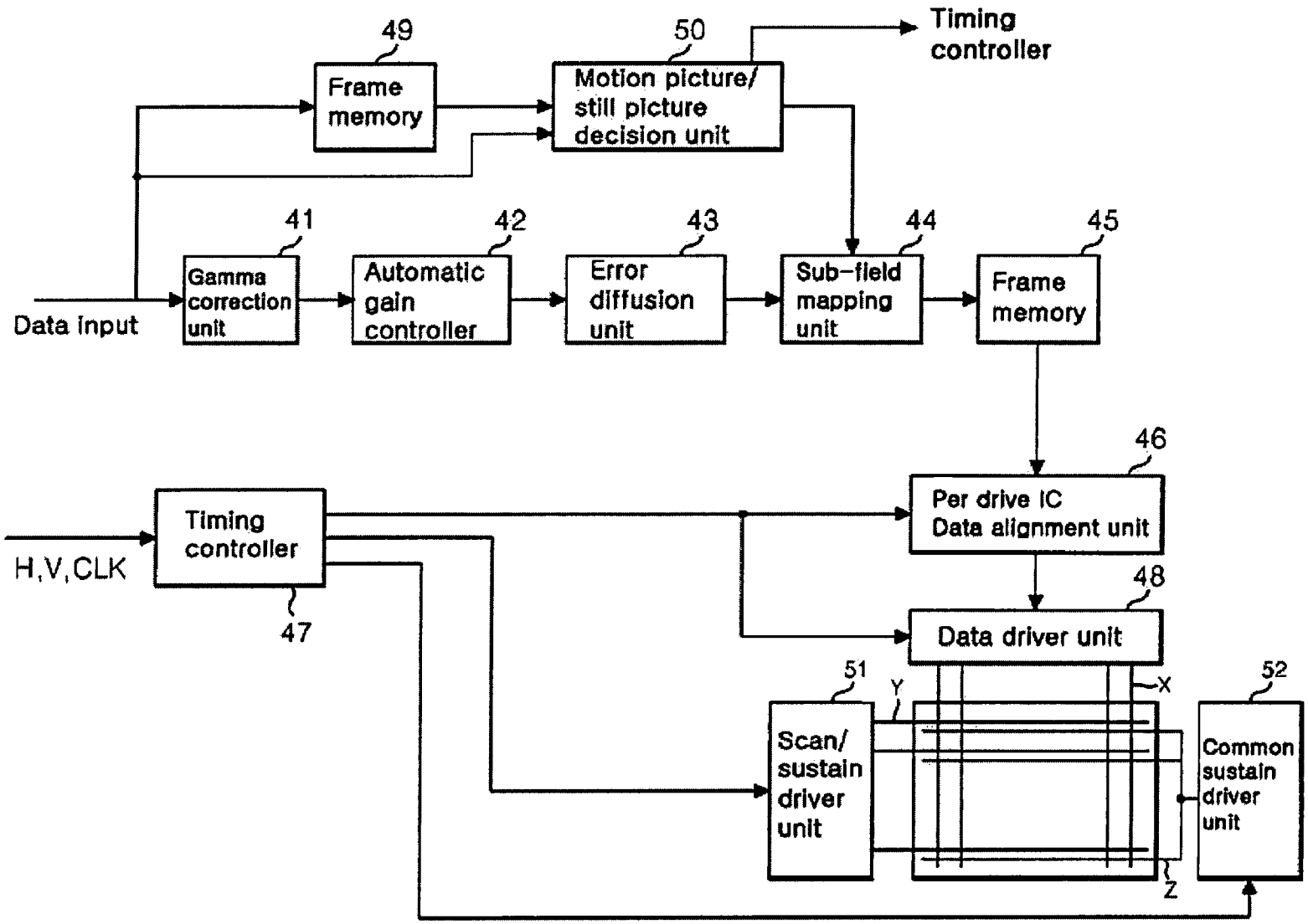
FIG. 8 is a block diagram illustrating an apparatus for driving a plasma display panel according to a second embodiment of the present invention.

FIG. 8 is a block diagram illustrating an apparatus for driving a plasma display panel according to anther embodiment of the present invention. In FIG. 8, the same components as those of the apparatus shown in FIG. 7 are assigned with the same reference numerals. Thus, description on them will be omitted in order to avoid redundancy.

Referring to FIG. 8, the apparatus according to the present invention includes a frame memory 49 and a motion picture/still picture decision unit 50 for determining a motion picture and a still picture.

The frame memory 49 serves to store data received from an input line of a digital video data for 1 frame period and thus delay the data for 1 frame period.

The motion picture/still picture decision unit 50 compares a previous frame data from the frame memory 49 and a current frame data from the input line to calculate the amount of variations in the data. Also, the motion picture/still picture decision unit 50 compares the calculated amount of variations in the data and a predetermined reference value to determine whether a picture has moved. If it is determined that the amount of variations in the data is higher than the reference value, the motion picture/still picture decision unit 50 determines a digital video data which is currently being received as a motion picture data. On the contrary, if it is determined that the amount of variations in the data is lower than the reference value, the motion picture/still picture decision unit 50 determines a digital video data which is currently being received as a still picture data. Further, the motion picture/still picture decision unit 50 supplies a signal indicating whether a data that is currently being received is a still picture or a motion picture to the sub-field mapping unit 44 and the timing controller 47.

The sub-field mapping unit 44 determines whether a picture that is currently being received has moved based on a signal received from the motion picture/still picture decision unit 50, and it selects an optimal sub-field arrangement based on the determination. Thereafter, the sub-field mapping unit 44 maps data to the selected sub-field arrangement by the bit. For example, the sub-field mapping unit 44 can map data to a sub-field arrangement in which SE sub-fields whose number is greater than that of SW sub-fields are disposed in the AV mode as in FIG. 4. On the contrary, the sub-field mapping unit 44 can map data to a sub-field arrangement in which SE sub-fields whose number is smaller than that of SW sub-fields are disposed in the PC mode as in FIG. 5.

The timing controller 47 receives horizontal/vertical synchronization signals H,V and a clock signal CLK to generate timing control signals necessary for the units 46, 48, 51 and 52, respectively. Furthermore, the timing controller 47 controls the number of sustain pulses differently according to a mode select signal received from the motion picture/still picture decision unit 50. That is, the timing controller 47 controls the scan/sustain driver unit 51 and the common sustain driver unit 52 using the number of sustain pulses that is set lower than the number of sustain pulses of a motion picture in the still picture. Accordingly, the scan/sustain driver unit 51 and the common sustain driver unit 51 generate different numbers of sustain pulses depending on whether a picture has moves under the control of the timing controller 47.

As described above, according to the present invention, an operating mode of a plasma display panel is determined as one of an AV mode and a PC mode using a remote controller, a cable signal and a signal of a mode select switch. Data is displayed in a sub-field arrangement where contour noise rarely appears in the AV mode, whereas data is displayed in a sub-field arrangement in which a range of the gray scale that can be represented is wide in the PC mode. Also, the number of the sustain pulse is controlled to be lower in the PC mode than in the AV mode. Further, whether a picture has moved is determined based on the amount of variations in a data, and data is displayed as an optimal sub-field arrangement and the number of sustain pulse is controlled, depending on whether the picture has moved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display panel, comprising the steps of:

determining the degree in which data moves;

selecting an operating mode based on the degree in which the data moves;

selecting a sub-field arrangement, while maintaining a constant number of sub-fields, and a number of sustain pulses of one frame period based on the selected operating mode, the sub-field arrangement including at least one selective write (SW) sub-field and at least one selective erase (SE) sub-field, wherein the number of SW sub-fields and SE sub-fields in the frame period are based on the selected operating mode; and controlling the plasma display according to the selected sub-field arrangement, wherein the at least one SW sub-field selects on-cells in an address period, and at least one selective erase (SE) sub-field that selects off-cells in an address period, wherein the step of controlling differently at least one of the arrangement of the sub-fields and the number of the sustain pulses comprises the step of: making the number of the selective write SW sub-fields to be greater than the number of the selective erase SE sub-fields if the operating mode is a PC mode in which the movement degree of the data is small.

2. The method as claimed in claim 1, further comprising the step of receiving at least one of a signal from a remote controller that remotely controls the plasma display panel, a cable signal connected to different media, and a signal from a mode select switch separately disposed in the plasma display panel.

3. The method as claimed in claim 2, wherein the step of selecting the operating mode includes determining the operating mode in response to the received signal.

4. The method as claimed in claim 1, wherein the step of determining the degree in which the data moves includes comparing frames of the data to calculate the amount of variations and comparing the amount of variations with a predetermined reference value.

5. The method as claimed in claim 1, wherein the number of the SE sub-fields is greater than the number of the SW sub-fields if the operating mode is an AV mode in which the movement degree of the data is great.

6. The method as claimed in claim 1, the sub-field arrangement further includes a first sub-field arrangement and a second sub-field arrangement, wherein the first sub-field arrangement is selected when the operating mode is an AV mode such that the SW sub-fields and SE sub-fields are arranged to reduce contour noise and the second sub-field arrangement is selected when the operating mode is the PC mode, wherein the gray scale range of the second sub-field arrangement is greater than the first sub-field arrangement.

7. The method as claimed in claim 1, wherein the step of controlling differently at least one of the arrangement of the sub-fields and the number of the sustain pulses comprises the step of:

if the operating mode is the PC mode in which the movement degree of the data is small, controlling the number of the sustain pulses to be smaller than the number of sustain pulses that is set corresponding to an AV mode in which the movement degree of the data is great.

8. The method as claimed in claim 1, wherein the step of controlling differently at least one of the arrangement of the sub-fields and the number of the sustain pulse comprises the step of:

if the operating mode is the PC mode in which the movement degree of the data is small, lowering the number of the sustain pulses so that the data can be displayed as the average brightness between 50% and 80% against the average brightness of the data that is displayed on the plasma display panel in an AV mode in which the movement degree of the data is great.

9. An apparatus for driving a plasma display panel, comprising:

a data movement decision unit that determines the degree in which data moves;

a mode select unit that selects an operating mode based on the degree in which the data moves; and a control unit that controls a sub-field arrangement, while maintaining a constant number of sub-fields, and the number of sustain pulses in one frame period according to the selected operating mode, the sub-field arrangement including at least one selective write (SW) sub-field and at least one selective erase (SE) sub-field, wherein the number of SW sub-fields and SE sub-fields in the frame period are based on the selected operating mode, wherein the control unit arranges, within the one frame period, at least one SW sub-field that selects on-cells in an address period and at least one SE sub-field that selects off-cells in an address period, and if the operating mode selected by the mode select unit is a PC mode in which the movement degree of the data is small, the control unit selects the number of the SW sub-fields to be greater than the number of the SE sub-fields.

10. The apparatus as claimed in claim 9, wherein the mode select unit receives at least one of a signal from a remote controller that remotely controls the plasma display panel, a cable signal connected to different media, and a signal from a mode select switch separately disposed in the plasma display panel; and determines the operating mode in response to the received signal.

11. The apparatus as claimed in claim 9, wherein the mode select unit compares frames of the data to calculate the amount of variations and compares the amount of variations with a predetermined reference value to select the operating mode.

12. The apparatus as claimed in claim 9, wherein the control unit arranges, within the one frame period, at least one SW sub-field that selects on-cells in an address period and at least one SE sub-field that selects off-cells in an address period, and if the operating mode selected by the mode select unit is an AV mode in which the movement degree of the data is great, the control unit selects the number of the SE sub-fields to be greater than the number of the SW sub-fields.

13. The apparatus as claimed in claim 9, wherein the control unit maps the data to a first sub-field arrangement in which sub-fields are arranged so that contour noise is small in a motion picture if the operating mode selected by the mode select unit is an AV mode in which the movement degree of the data is great, and maps the data to a second sub-field arrangement in which sub-fields are arranged so that a range of the gray scale to be represented is wider than that of the first sub-field arrangement if the operating mode selected by the mode select unit is the PC mode in which the movement degree of the data is small.

14. The apparatus as claimed in claim 9, wherein the control unit controls the number of the sustain pulses to be smaller than the number of sustain pulses that is set corresponding to an AV mode in which the movement degree of the data is great if the operating mode selected by the mode select unit is the PC mode in which the movement degree of the data is small.

15. The apparatus as claimed in claim 14, wherein the control unit lowers the number of the sustain pulses so that the data can be displayed as the average brightness between 50% and 80% against the average brightness of the data that is displayed on the plasma display panel in the AV mode in which the movement degree of the data is great if the operating mode selected by the mode select unit is the PC mode in which the movement degree of the data is small.

* * * * *